US008820595B2

(12) United States Patent
Reilly

(10) Patent No.: US 8,820,595 B2
(45) **Date of Patent: *Sep. 2, 2014**

(54) METHOD FOR USING A HANGER SYSTEM

(71) Applicant: Traci Linn Reilly, Keller, TX (US)

(72) Inventor: Traci Linn Reilly, Keller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/952,138

(22) Filed: Jul. 26, 2013

(65) Prior Publication Data

US 2013/0309059 A1 Nov. 21, 2013

Related U.S. Application Data

(62) Division of application No. 12/829,365, filed on Jul. 1, 2010, now Pat. No. 8,523,027.

(60) Provisional application No. 61/269,937, filed on Jul. 1, 2009.

(51) Int. Cl.
*A41D 27/22* (2006.01)

(52) U.S. Cl.
USPC ..... 223/95; 223/88; 223/91; 223/96

(58) Field of Classification Search
CPC ..... A47G 25/487
USPC ..... 223/85, 88, 91, 95, 96; 211/85.3, 106, 211/119
See application file for complete search history.

(56) References Cited

U.S. PATENT DOCUMENTS

| | | | | |
|---|---|---|---|---|
| 1,008,327 | A | | 11/1911 | Hamilton |
| 1,911,208 | A | | 5/1933 | Roman et al. |
| 2,420,196 | A | | 5/1947 | Robin |
| 2,486,749 | A | | 11/1949 | Marks |
| 2,717,108 | A | | 9/1955 | Schaerer |
| 2,940,650 | A | | 6/1960 | Hirata |
| 3,115,286 | A | | 12/1963 | Bassin |
| 3,281,028 | A | * | 10/1966 | Oppenheimer ..... 223/96 |
| 4,363,430 | A | | 12/1982 | Radlin |
| 4,416,401 | A | | 11/1983 | King |
| 4,953,717 | A | | 9/1990 | Rösch |
| 5,052,600 | A | | 10/1991 | Elchisak et al. |
| 5,277,345 | A | | 1/1994 | Ozaki |
| 5,402,558 | A | | 4/1995 | Santapa |
| 5,509,587 | A | | 4/1996 | Gouldson et al. |
| 5,680,972 | A | | 10/1997 | Clarke |
| 5,975,384 | A | | 11/1999 | Manabat |
| 6,062,445 | A | | 5/2000 | Nakamoto |
| 7,237,700 | B2 | | 7/2007 | Bulovic |
| 7,328,822 | B2 | | 2/2008 | Stokes |

FOREIGN PATENT DOCUMENTS

CA 453378 A 12/1948

* cited by examiner

*Primary Examiner* — Nathan Durham
(74) *Attorney, Agent, or Firm* — Crowell & Moring LLP

(57) ABSTRACT

A hanger system with hooks attached to and suspended from a hanging or stationary frame, and from one to a multiplicity of rods capable of holding garments or other items, which rest in the hooks. The hooks are designed to allow the rods to rest in vertical relation to one another within the hooks although, depending on the hanging orientation of the hanger system, the rods may hang adjacent to or diagonal from one another. The frame may be hung from a closet rod or similar support, or may be attached to a surface such as a wall or a shelf, either directly or with spacers between the frame and the surface.

17 Claims, 11 Drawing Sheets

METHOD FOR USING A HANGER SYSTEM

CROSS REFERENCE TO RELATED APPLICATIONS

This application is a divisional of application Ser. No. 12/829,365, filed Jul. 1, 2010, which claims the benefit under 35 U.S.C. §119(e) of U.S. Provisional No. 61/269,937 filed on Jul. 1, 2009, hereby incorporated by reference.

TECHNICAL FIELD

The present invention relates to hangers, and specifically to hangers which hold multiple garments or other items. The hanger system has multiple rods and can hold garments which have straps or which are sleeveless or garments or other items which can be draped over the rods of the hanger. The hanger system can also hold garments with sleeves when a conventional hanger is attached to it.

BACKGROUND

There are a variety of clothing hangers on the market, and they serve a variety of purposes. Some have hooks, clips or other attachments to hang different types of clothing, see U.S. Pat. Nos. 5,509,587 and 5,680,972, some have extendable arms for different sized clothing as in U.S. Pat. Nos. 7,328,822 and 6,062,445, and some have multiple bars or rods at the bottom for hanging multiple articles of clothing as in U.S. Pat. No. 7,237,700. However, all these hangers, in a closet, tend to get tangled together, and to crowd the closet. To relieve these problems, hangers have been developed that are designed to hold a multiplicity of other hangers as in U.S. Pat. No. 4,953,717 or 4,416,401. These "super" hangers take less room in the closet, as they are often configured in such a way as to allow the subsidiary hangers to be able to hang vertically in relation to one another, suspended from the "super" hanger. However, these arrangements often result in the clothing being difficult to insert and remove, either due to obstruction or friction from adjacent garments or because the garment being removed catches on buttons or other attachments on neighboring items. This can result in garments adjacent to the one being removed coming loose from their hangers and falling to the floor.

SUMMARY OF THE INVENTION

The current invention is intended to overcome the drawbacks of the existing products, while allowing users to increase organization and easily and neatly hang and store clothing or other items, while maximizing storage and providing improved ease of inserting and removing items.

This invention will provide a hanger system that allows multiple garments to be hung on it while taking up less room in a closet than if the same clothes were hung on traditional hangers. It will allow the garments to hang from rods that are in vertical relation to one another, but will allow the garments to be inserted and removed easily while minimizing the clothing binding or catching on adjacent garments. Depending on the orientation of the hanger system, the rods may instead be adjacent to or in a somewhat diagonal relation to one another rather than in vertical relation to one another.

This invention will provide a hanger system that is capable of hanging from one to multiple garments, but allowing the garments to be inserted and removed easily and without binding or catching on other clothes or items when being removed from the hanger system. The hanger can also be used in a retail setting to display several garments while allowing relatively large portions of multiple garments, for example, decorative pockets of jeans or different colors and patterns of camisoles or scarves, to be displayed in a minimal amount of space. It can be used for pants, T-shirts, scarves or any item which can be draped or folded over the rods of the invention, or for garments such as camisoles, sleeveless shirts or bras, whose straps can be suspended over the rods of the invention. It can also be used for storing such things as wrapping paper rolls or rolls of ribbon. To allow shirts with sleeves to hang from the hanger system, one or more conventionally shaped hangers can be hung from the rods.

This hanger system will also allow the user to easily inventory clothing and to determine which garments get worn infrequently or not at all. The clothes which were hung on the hanger system most recently will be on the upper rods, and the clothes that have been on the hanger system the longest will be toward the bottom. This allows users to determine whether they have clothes which they seldom or never wear anymore, and the user can determine whether those garments should be discarded, donated or otherwise removed from their closet.

With this invention, pants or slacks can be hung on a rod which is thicker than the bar or trouser bar of a conventional hanger, thus reducing or eliminating the horizontal crease in the leg of the garment that arises from hanging on a narrow hanger.

Use of this invention instead of conventional hangers can minimize empty, loose hangers in the closet, as well as providing a convenient storage place for the rods which hold the clothes in the closet. This will help the closet or storage space appear more organized. Additionally, using this invention instead of conventional hangers can reduce or eliminate the problem of having hangers getting entangled with one another on the closet rod. Use of this invention can also help organize closets, by allowing different categories of clothing to be stored on each hanger, such as having one hanger hold all jeans, while another hanger holds scarves or camisoles. Use of this invention can also make more storage space available by utilizing more vertical space.

DETAILED DESCRIPTION

Figure 1:
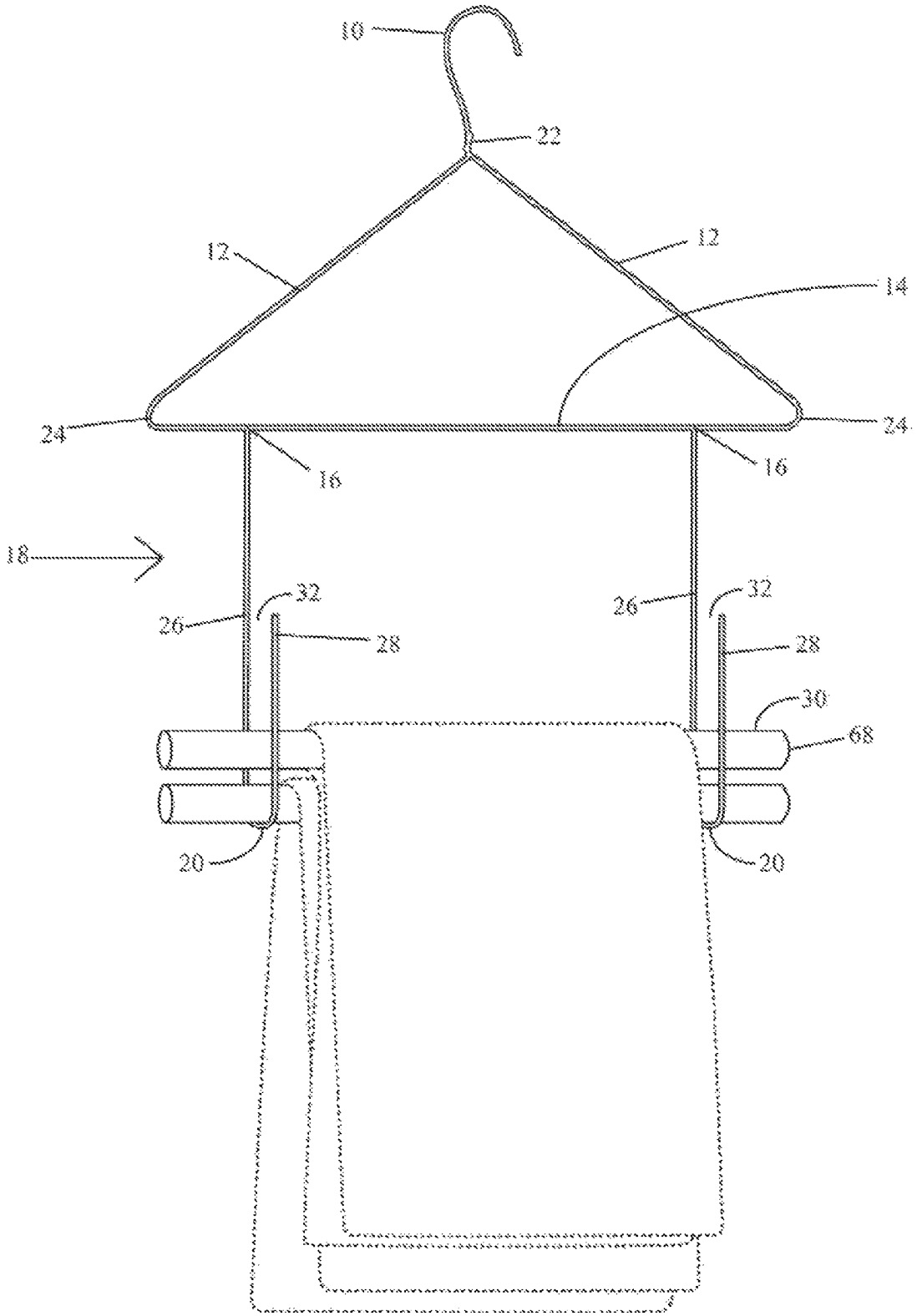
FIG. 1 is a perspective view of the first embodiment of the hanger system with rods inserted, with garments hanging on it.

FIG. 1 shows a perspective view of one embodiment of the hanger system. A curved portion 10 which is shaped like a hook allows the hanger system to be hung on a closet rod or other longitudinal surface. Two support arms 12 extend downward at an angle from the neck 22 of the curved portion 10. Connecting the support arms and running longitudinally between the terminal ends 24 of the support arms is a bar 14. Two hooks, shown generally at 18, each of which has a first side 26 and a second side 28, each have their first sides attached to the bar at points 16. The hooks can be rigidly attached to the bar, or they can be flexibly attached. In one embodiment, the hooks are generally j-shaped or u-shaped, with the first side 26 longer than the second side 28. The hooks are each in a plane orthogonal to the roughly triangular portion of the hanger system formed by the two support arms 12 and the bar 14. Longitudinally-held rods 30 are capable of being passed through the openings 32 between the first and second sides 26, 28 of the hooks.

The first rod inserted into the hooks will come to rest on the bottom 20 of the hook. Rods which are inserted while another rod or rods already rests in the hooks will come to rest on the uppermost rod already in the hooks. In use, garments such as slacks or T-shirts or items such as curtains or scarves are draped over the rods. If the dimension of the garments or items would normally extend past the portion of the rod that extends past the hooks, the garments or items should be folded or otherwise adjusted on the rod so that they fit between the first and second hooks. The rod, with the garment or item draped over or otherwise resting on it, is then held longitudinally and inserted in the openings between the two sides of the hooks, and lowered until the rod and the garment or item on it come to rest, either upon a previously inserted rod 30, or on the bottom 20 of the hooks. If a rod is already present in the hooks, the portions of the garment or item which hang from the two sides of the rod which is being inserted are kept together so they are both on the same side of the rod below. With garments such as camisoles, bras and other garments that have shoulder straps, the shoulder straps can be hung on the rods, and the rods can then be inserted into the opening between the two sides of the hooks.

Figure 2:
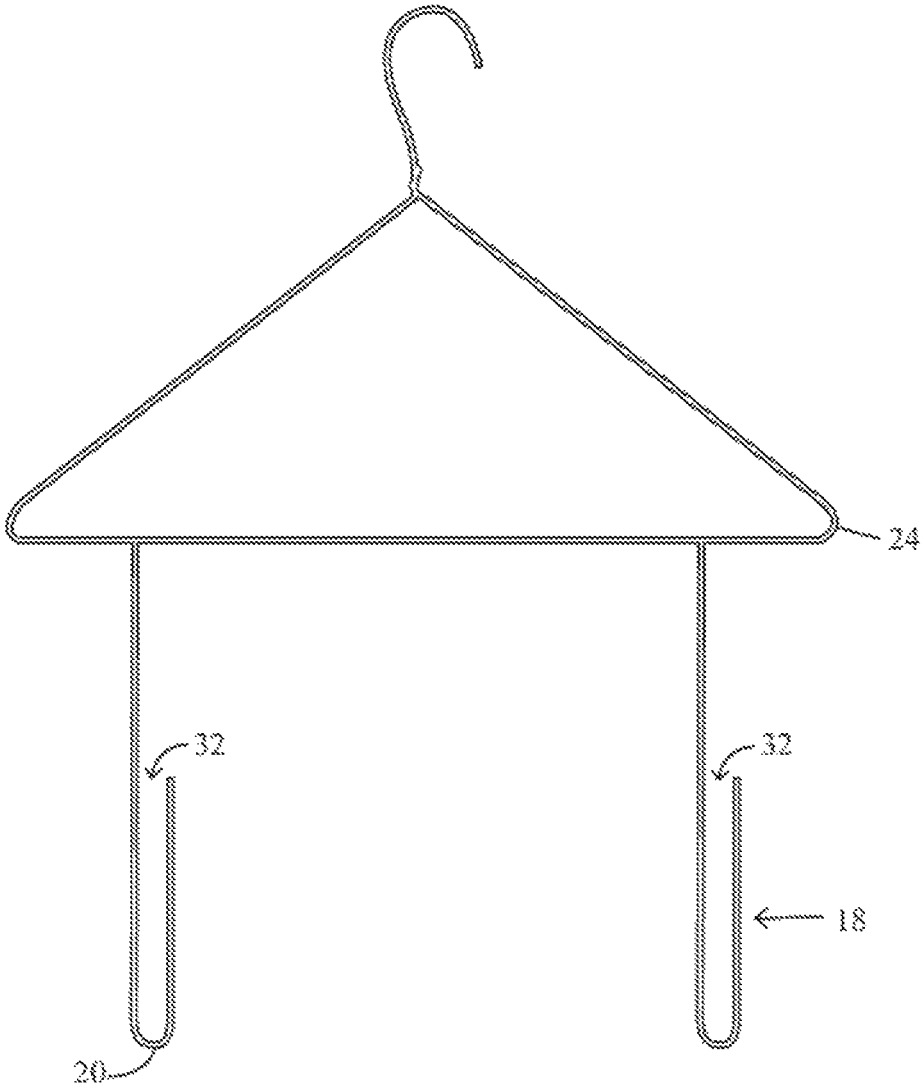
FIG. 2 is a perspective view of the first embodiment of the hanger system with no rods inserted.
Figure 3:
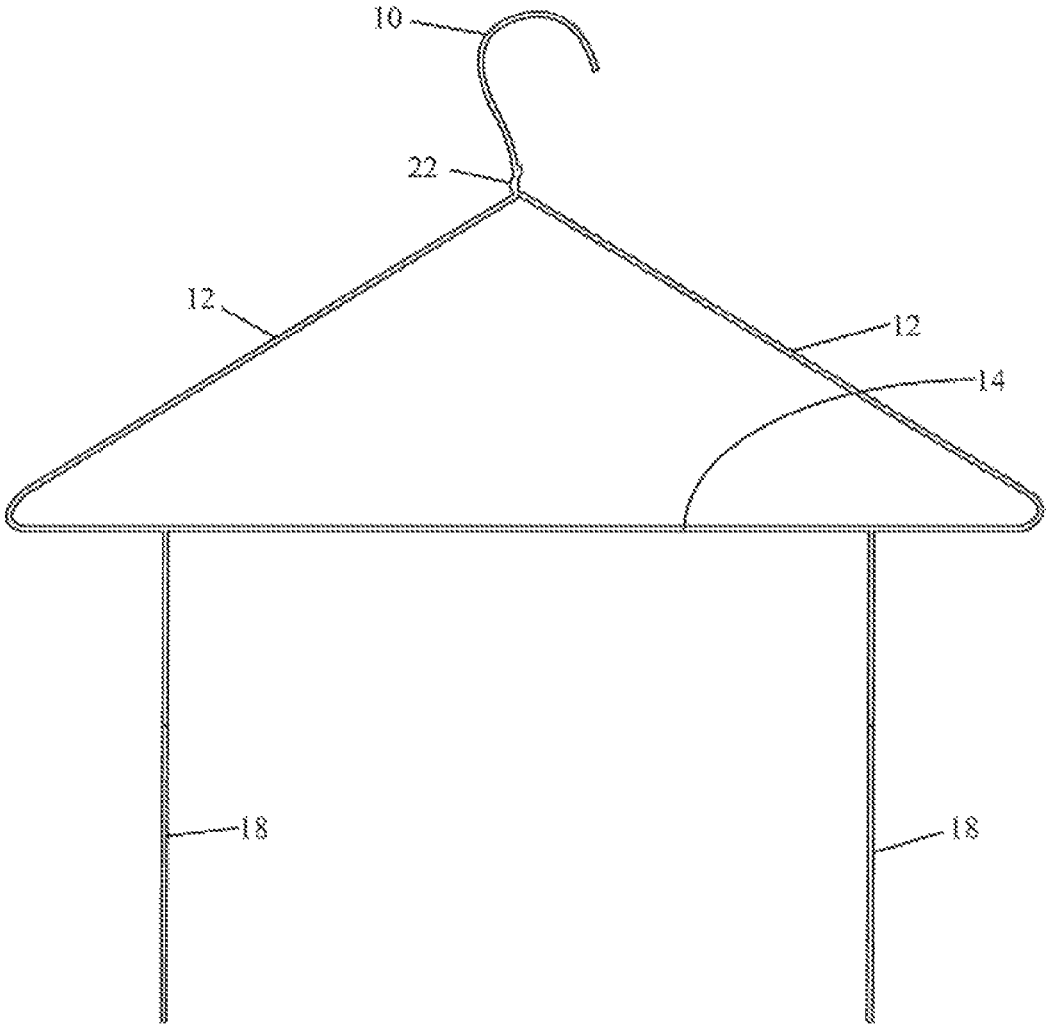
FIG. 3 is a front view of the hanger system with no rods inserted.
Figure 4:
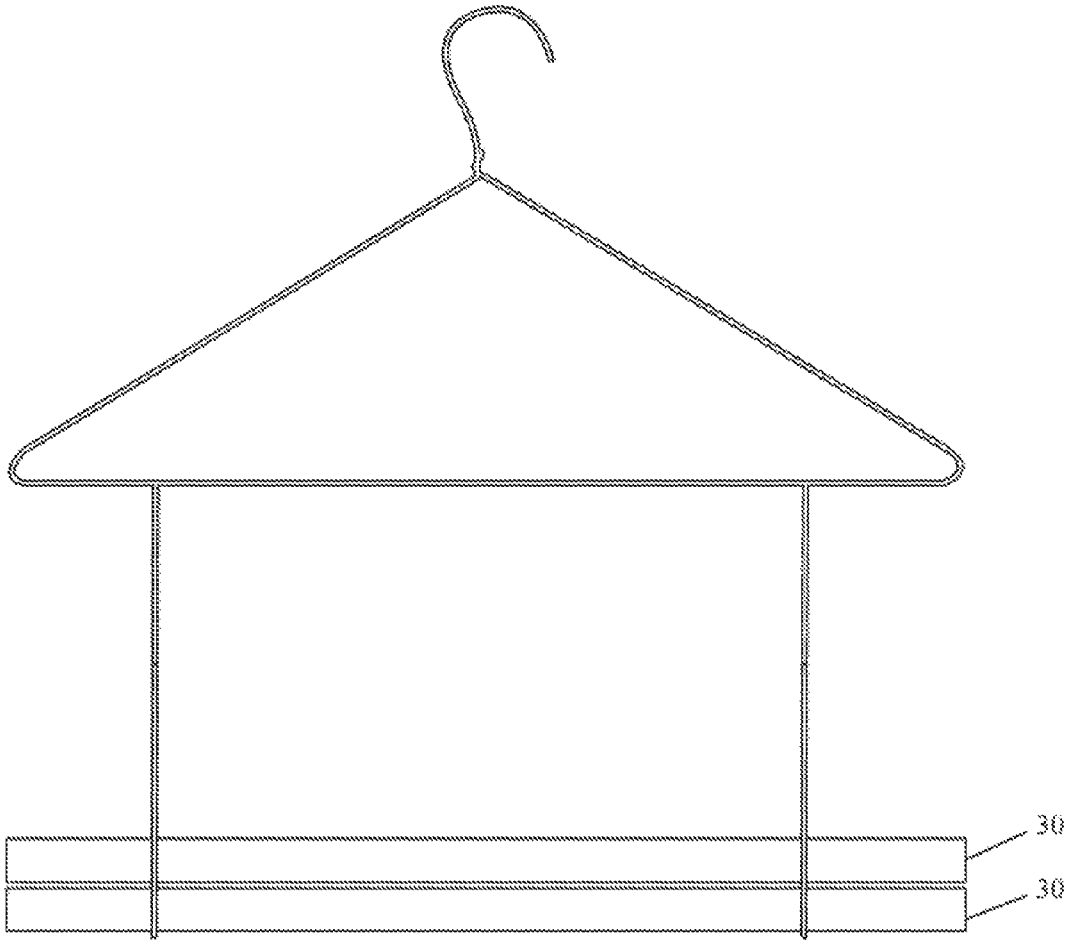
FIG. 4 is a front view of the first embodiment of the hanger system with rods inserted.
Figure 5:
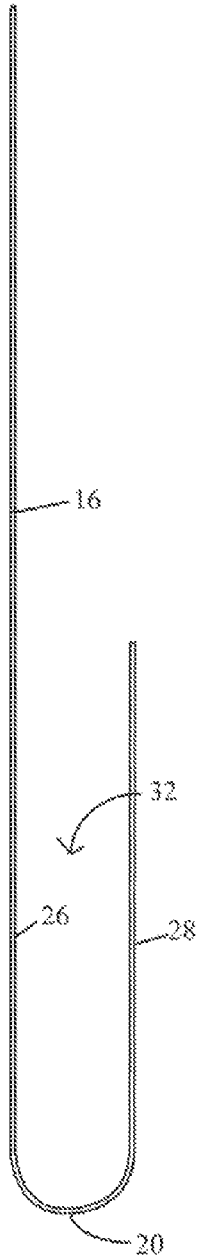
FIG. 5 is a side view of the first embodiment of the hanger system with no rods inserted.
Figure 6:
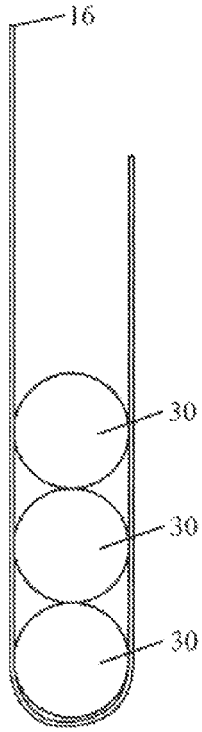
FIG. 6 is a side view of a hook used in the first embodiment of the hanger system with rods inserted.
Figure 12:
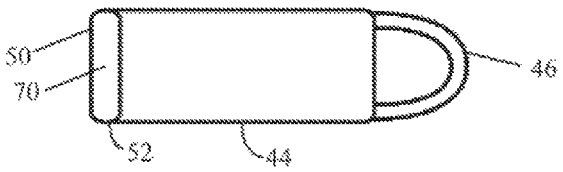
FIG. 12 shows a perspective view of an alternative embodiment of the rod in which the rod has an oblong shaped profile and a handle.

In FIG. 2, the hanger system is shown with no rods in place. In FIG. 3, it can be seen that the two support arms 12 and the horizontal portion 14 are collectively in the same plane as the curved portion 10 and the neck 22 of the hanger system, while the hooks 18 are in an orthogonal plane relative to the two arms and the bar. FIG. 4 shows that, in the first embodiment of the invention, the rods 30 rest directly adjacent to one another when they do not have garments or items on them. When they do have garments or items on them, they will rest adjacent to one another, but the garments will cover a circumferential portion of the rod, thus effectively causing the garments to rest on one another while held in place by the rods. FIG. 5 shows the profile of the hanger system showing the hooks used in the first embodiment. The first and second sides of the hooks are long enough to allow the insertion of several rods. The number of rods which can be inserted into the hooks depends, in part, on the length of the first and second sides of the hooks, the thickness of the rods, and the weight of the clothing or items being hung on the rods. The rods can be of different diameters or different cross-sectional shapes such as oblong as shown in FIG. 12 or triangular, rectangular or elliptical. The first and second sides of the hooks are spaced far enough apart to allow the rods to slide smoothly between the sides of the hooks while not binding, but close enough to force the rods to rest in essentially vertical relation to one another when the hanger system is used vertically, as shown in FIG. 6. It is also possible to use the hanger system in a non-vertical orientation, such as diagonally or horizontally. The diameter or thickness 74 of the rods will dictate how far apart from each other the first and second sides of each hook are, as the sides of the hooks are spaced apart sufficiently to allow the rods enough space to enter and exit the hanger system with ease while maintaining the rods in a singular row configuration.

Figure 7:
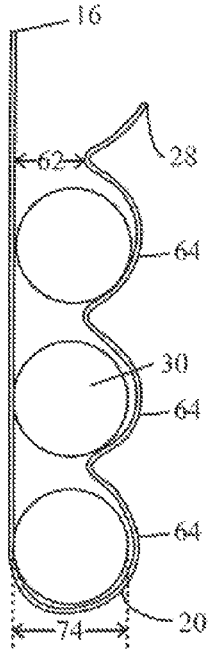
FIG. 7 is a side view of a hook used in a second embodiment, with rods inserted.

FIG. 7 shows an alternative embodiment, in which the second sides 28 of the hooks have a contoured shape, conforming roughly to a portion of the profile of the rod 30. In this embodiment, the rods are held in a slightly separated position from one another. This allows for easier removal of the garments on the rods. In this embodiment, when inserting the rods into the opening between the sides of the hooks, the user will need to push the rods toward the bottom 20 of the hooks in order to get the rods into the lowermost available position. Since the upper rods will not, by themselves, settle into a lower position when a rod beneath them is removed, the user will need to manually push the upper rods into a lower position when there is a position available in order to maximize hanger storage. The hooks are made of a material that can be temporarily deformed by pushing the rods through the narrowest portion 62 of the space between the first and second sides of the hooks, and yet will return to its original position once the rod has passed that point, thus allowing the rod to rest in the contoured portion 64 of the second side of the hook. It is also possible to have both sides of the hook or only the first side of the hook have a contoured shape.

Figure 8:
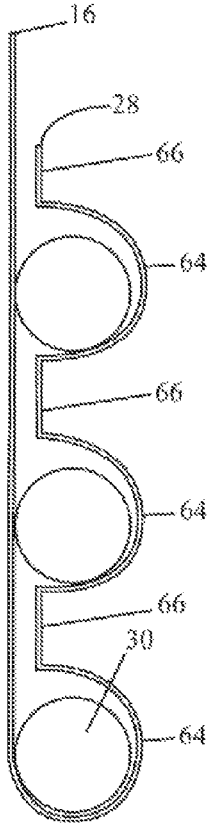
FIG. 8 is a side view of a hook used in a third embodiment, with rods inserted.

FIG. 8 shows another variation of the configuration of the hook. In this embodiment, the second side 28 of the hook is contoured 64 periodically to conform to the profile of the rods 30, but the portions of the hook which are designed to accept the rods are separated by straight sections 66 of the second side of the hook. It is also possible to have both sides of the hook or only the first side of the hook have a contoured shape. This embodiment allows a larger portion of the garments or items stored on the hanger system to be displayed than would be visible otherwise. This embodiment could be particularly useful in a retail setting, where a large portion of a multiplicity of garments can be displayed in a relatively small amount of space. In this embodiment, as in the previous one, the user would need to push the rod into position when inserting it, as it will not fall to rest in the lower position by itself.

Figure 9A:
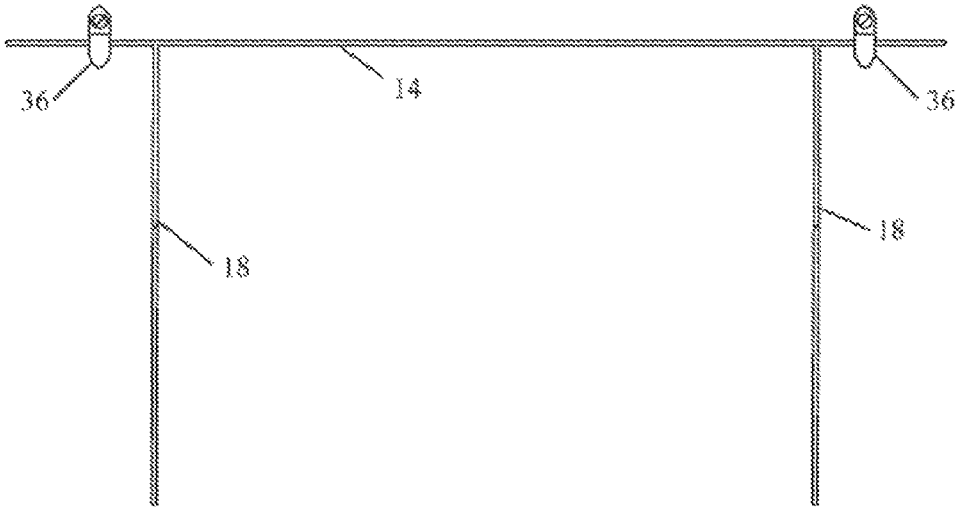
FIG. 9A shows a front view of an alternative embodiment of the hanger system in which the bar of the hanger system is attached directly to a wall or other surface.
Figure 9B:
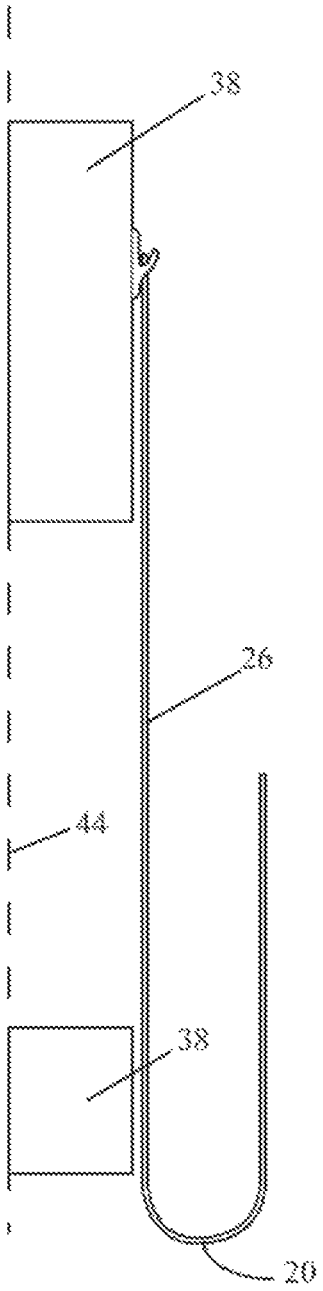
FIG. 9B shows a side view of an alternative embodiment in which the bar of the hanger system is attached to a surface with spacers between the bar and the surface, and between the hooks and the surface.

In FIG. 9A, the bar 14 of the hanger system is attached directly to a wall, door, shelf or other surface with a means of attachment 36, rather than hanging from the curved portion and the support arms. In this embodiment, the support arms and curved portion of the hanger system need not be present. As shown in FIG. 9B, spacers 38 can be put between the bar and the surface 44 to which it is attached and, if desired, between the first side of the hook and the surface, thus allowing the bar and the hooks to rest a distance from the surface to which the hanger system is attached. The addition of the spacers allows space for the rods and the garments or items hanging on them to slide easily to their resting place, either at the end 20 of the hooks, or on previously placed rods, while reducing having the rods or the garments or other items stored on the rods rubbing against the surface upon insertion into the hooks.

Figure 10A:
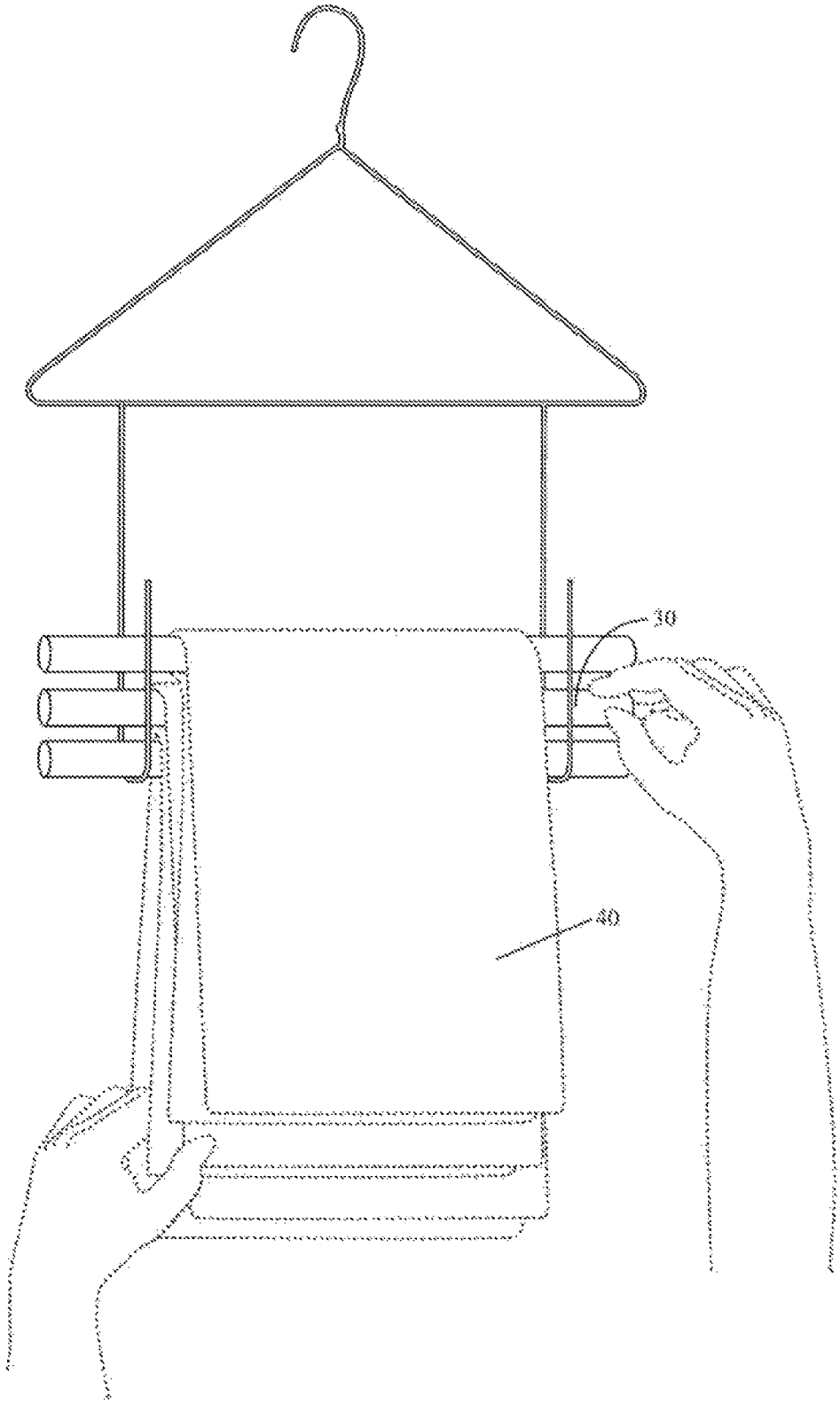
FIGS. 10A and 10B show a user removing a garment or item from the hanger system.
Figure 10B:
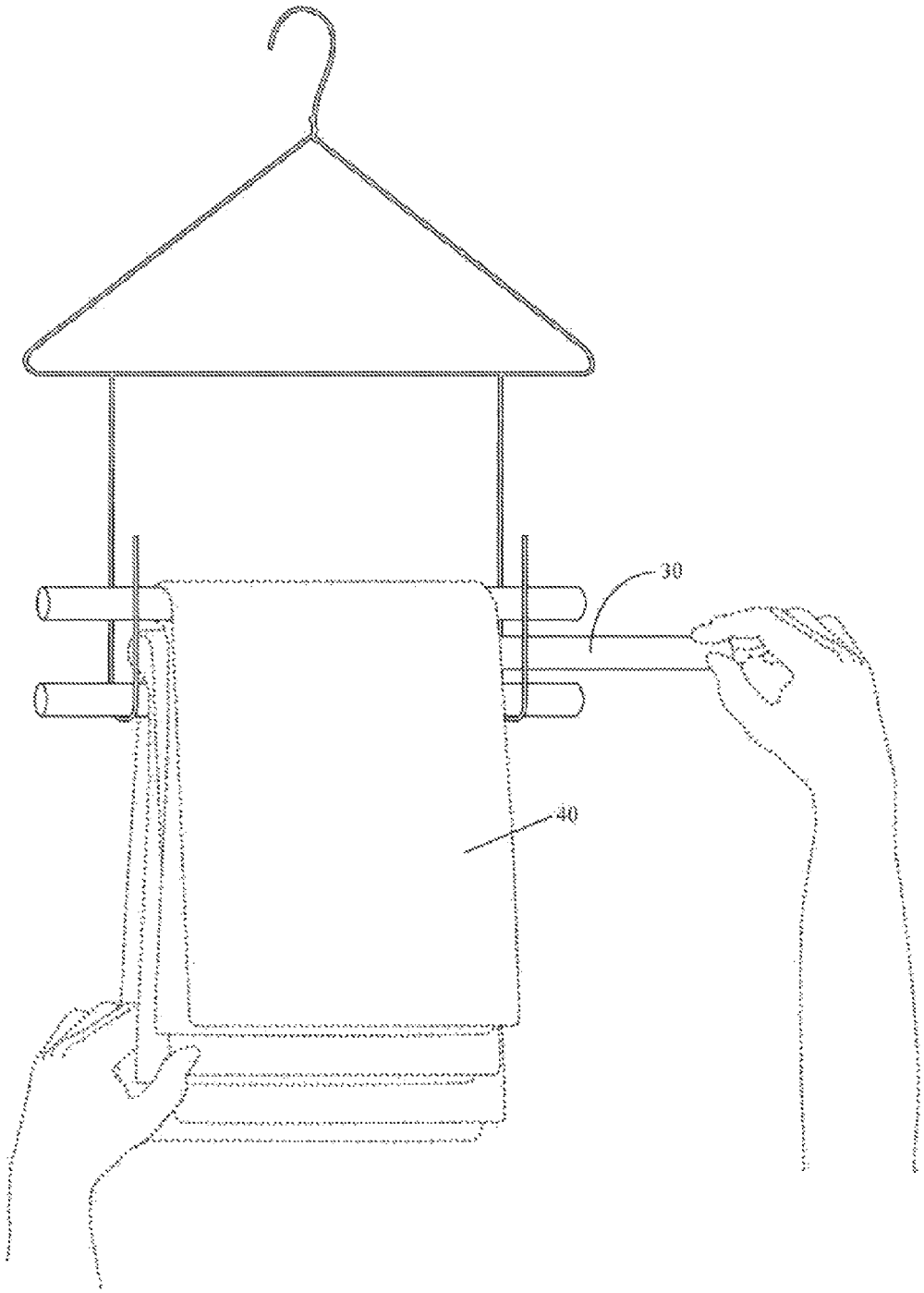

In order to remove the garments or other items from the rods, the user simply holds a portion of the garment or item 40 near the rod with one hand and grasps an end of the rod with the other hand as shown in FIG. 10A then removes the rod 30 by sliding it out longitudinally as shown in FIG. 10B. Once the rod has been removed from the hooks, the rod is in one of the user's hands, and the garment that formerly was on the rod is in the user's other hand. The garments that were adjacent to the garment removed remain securely on their rods. Unless the hooks are contoured to keep the rods in place, if the hanger system is being used vertically or on an angle, the rods above the rod which has been removed will drop down once the rod below has been removed. In the case where the hooks are contoured to keep the rods in place, the user can manually push the above rods to a lower position.

Rods that are not holding garments or other items can be stored in the hooks. For example, if a garment has just been removed from a rod, the empty rod can be inserted through the openings 32 between the sides of the hooks and lowered until it comes to rest, either on the bottom of the hooks or on top of a previously placed rod, whether or not the previously place rod is holding a garment or other item. If desired, one rod can be permanently affixed to the bottom of the hooks to give added stability to the hooks.

Figure 11:
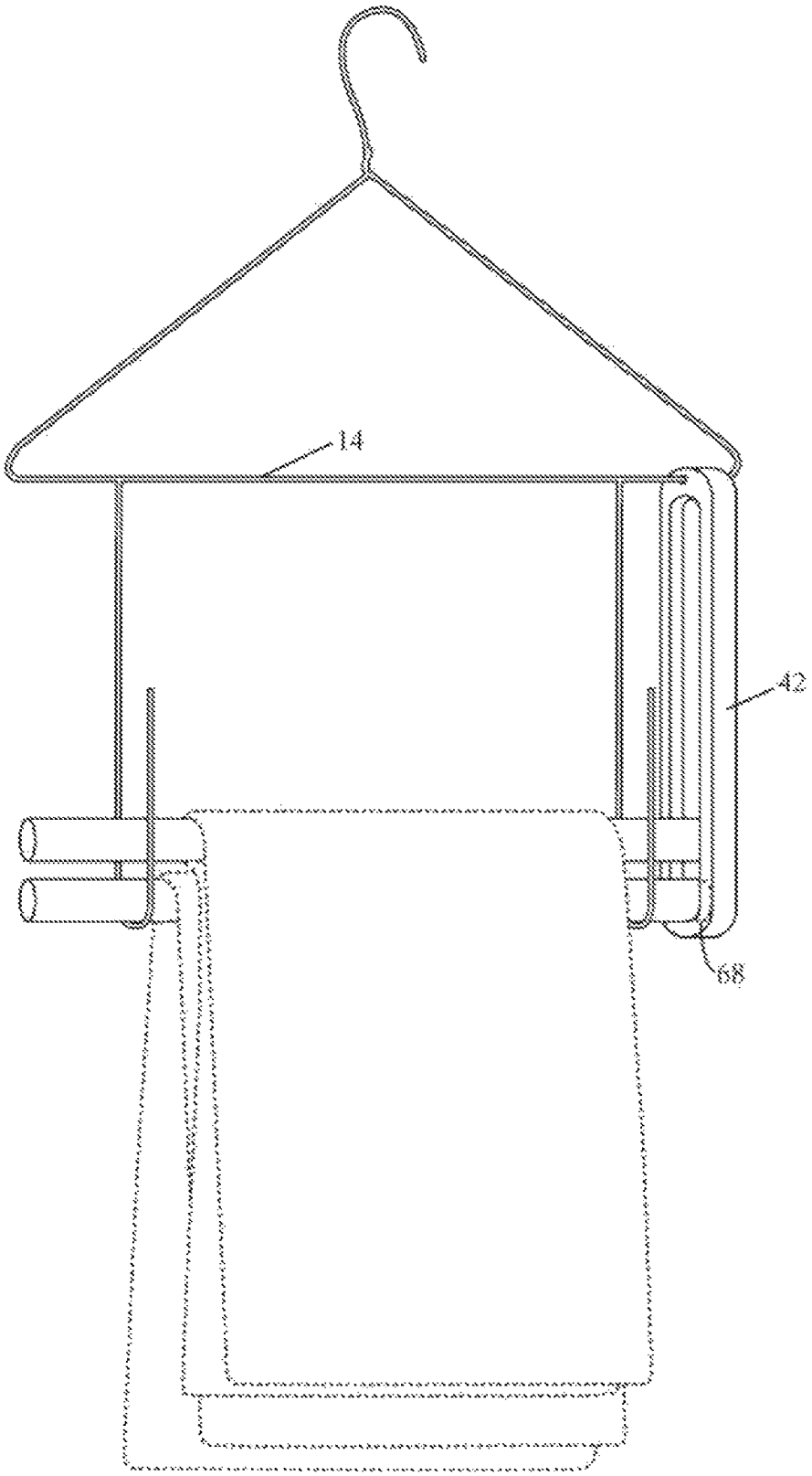
FIG. 11 shows an optional side stabilizer that allows the ends of the rods to easily be aligned with one another.

FIG. 11 shows an optional stabilizer 42 on one side of the hanger system. The stabilizer can enclose the end portion of the rods on the hanger system. It allows the user to align the ends 68 of the rods so they are directly above or below one another by pushing them toward the stabilizer, allowing for a neater appearance. The stabilizer can also be used to help keep the rods and the items on them secure on the hanger during transport, by preventing them from falling out of hooks. Stabilizers can be used to align and stabilize the rods at one end of the hanger system or at both ends. The stabilizer can be suspended from the bar 14 of the hanger or from the support arms.

If the hanger and attached hooks are made of metal, the metal should be of a heavy enough gauge that it will not deform under the weight of the rods and accompanying garments resting between the first and second sides 26, 28 and on the bottom 20 of the hooks. Alternatively, the hanger and attached hooks can be made of plastic or wood or any other suitable material. The rods may be made of any suitable material, and should be sturdy enough to hold the garments or items without bending or deforming.

FIG. 12 shows an alternate embodiment of the rod 44, in which the rod profile 70 has an elongated shape, with a long side 50 and a short side 52. In the figure, the rod profile is oblong, but any elongated shape can be used. In this embodiment, as the rod rests in the hooks, the shorter side 52 of the rod rests on either the rod below or on the bottom of the hooks, while the longer side 50 of the rod runs in the same direction as and is roughly parallel to the first and second sides of the hooks, enabling a larger portion of the clothing or other items hanging on the rod to be visible. An optional handle 46 can be attached to one end of the rod to more easily enable the removal of the rod from the hooks. The handle can be attached to an end of the rod regardless of the shape of the profile of the rod.

Figure 13:
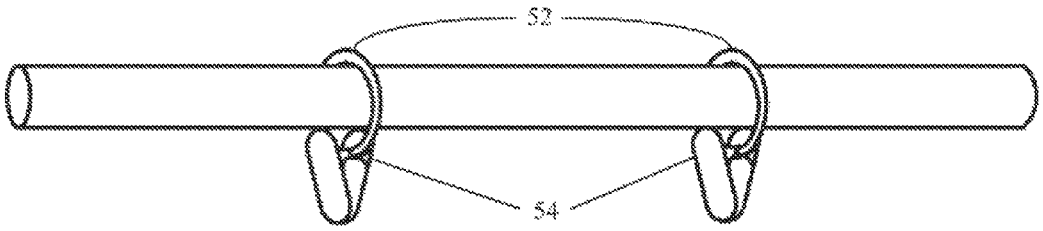
FIG. 13 shows a perspective view of a rod and rings which can slide over the rod. In the embodiment shown, clips are attached to the rings, although other items, such as hangers, can be attached to the rings.

FIG. 13 shows an embodiment of the invention in which loops or rings 52 can slide over the rod. The rings are capable of having clips 54, hangers (not shown), small hooks (not shown), or other devices attached to them, so that clothes, accessories or other items can be attached to and hung from the rings. The rings are sized so that they fit easily around the diameter of the rod. The loops and attached clips or devices for holding clothes or accessories can slide easily from the rod in the same manner in which clothing can slide off. The user can grasp the item held by the ring or rings with one hand, while sliding the rod from the hooks with the other. Once the rod has been removed from the hooks, the user will have the rod in one hand, and the item, with the clip or other device still attached, in the other. The rod can be re-inserted into the hooks for storage, while the clips and rings can be removed from the item so the item can be worn or used. The rings can be stored on an empty rod. Alternatively, the user can remove the garment or item from the clip or hanger, leaving the rod in place.

Figure 14:
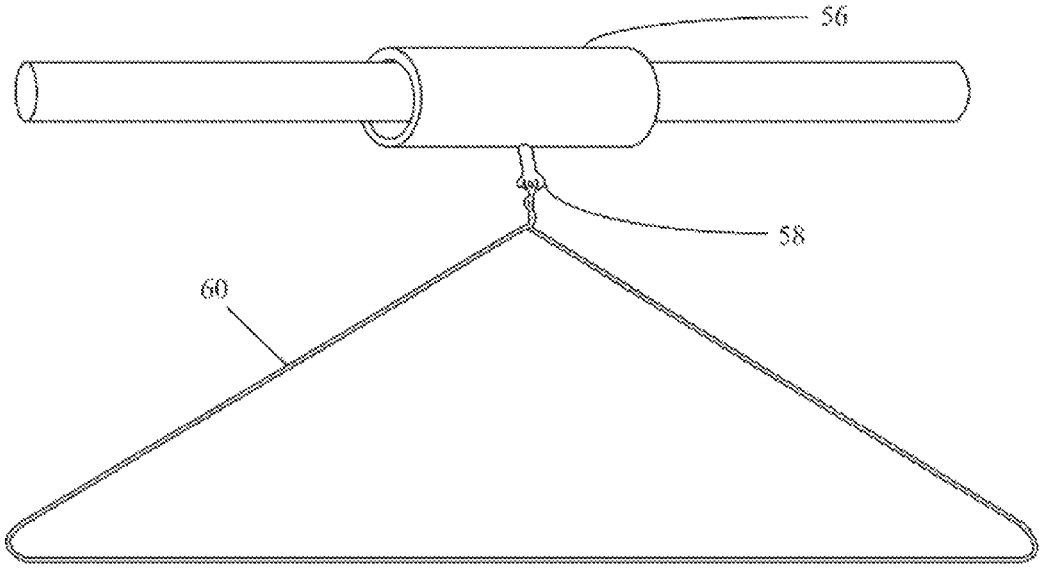
FIG. 14 shows a perspective view of rod and a sleeve which can slide over the rod. In the embodiment shown, a hanger on a pivot is attached to the sleeve, although other items such as clips or small hooks can be attached to the sleeve to hold clothing or other items on the rod.

FIG. 14 shows an embodiment of the invention in which a sleeve 56 fits over the rod. The length of the sleeve is less than the distance between the first and second hooks. Clips or small hooks can be attached to the sleeve so that belts or other accessories can be hung from the sleeve which hangs around the rod. Alternatively, a hanger 60 can be attached to the sleeve. In the embodiment shown, one end of a hanger 60 attaches to the sleeve and a pivoting fitting 58 in the neck of the hanger allows the hanger to hang at a variety of angles depending on what other garments are on the rods above and below it.

What is claimed is:

1. A method of removing items stored on a hanger system comprising:

receiving a plurality of rods into spaced apart first and second hooks, each of said hooks having first and second spaced apart sides, an opening and a bottom arranged opposite to the opening, said plurality of rods being of a length that is longer than the distance between the two hooks;

grasping an item stored on one of the plurality of rods with a user's first hand and grasping said one of the plurality of rods that is supporting the item with the user's second hand; and pulling said one of the plurality of rods longitudinally from between the first and second spaced apart sides with the second hand while continuing to hold the item with the first hand, wherein the spacing between the first and second sides are greater than a largest width of the plurality of rods so that each of the plurality of rods are longitudinally removable by said pulling.

2. The method of claim 1, wherein said grasping comprises grasping the item stored on the one of the plurality of rods with the user's first hand and grasping a handle attached to said one of the plurality of rods that is supporting the item with the user's second hand.

3. The method of claim 1, wherein a terminus of the first side of each hook is attached to a bar of the hanger system.

4. The method of claim 1, wherein a terminus of the first side of each hook is attached to a surface.

5. The method of claim 4, wherein the surface comprises one of a wall, door and shelf.

6. A method for providing a hanger system comprising:

configuring spaced apart first and second hooks each of said hooks having first and second spaced apart sides, an opening and a bottom arranged opposite to the opening; and configuring a plurality of rods to be received into the hooks through the opening, where the spacing between the first and second sides are greater than a largest width of the plurality of rods so that the rods are longitudinally removable via the first and second spaced apart sides, and where the plurality of rods are of a length that they are longer than the distance between the two hooks, the plurality of rods each being mounted for longitudinal movement so that items stored on the hanger system can be removed by grasping the desired item stored on any one of the plurality of rods with a user's first hand and grasping the rod holding the item with the user's second hand, and pulling the rod longitudinally from between the first and second spaced apart sides with the second hand while continuing to hold the item with the first hand.

7. The method of claim 6, wherein configuring the plurality of rods to be received into the hooks through the opening further comprises configuring the plurality of rods to rest, adjacent to one another, in the hooks.

8. The method of claim 6, further comprising configuring the one of the plurality of rods with a handle attached to an end.

9. The method of claim 6, further comprising configuring the hanger system with a curved portion in the shape of a hook, where the curved portion ends in a neck, and with two support arms, each of which has a first end and a second end, where the first ends of both support arms are attached to and extend at an angle from the neck.

10. The method of claim 6, further comprising configuring the hanger system with a neck having a first and a second end, where the first end of the neck ends at a curved portion in the shape of a hook.

11. The method of claim 6, further comprising attaching a stabilizer to one end of the one of the plurality of rods such that the stabilizer encloses the said one end.

12. The method of claim 6, further comprising fitting a sleeve over a longitudinal portion of the one of the plurality of rods, wherein a length of the sleeve is shorter than a length of the one of the plurality of rods.

13. The method of claim 12, further comprising attaching a clothes hanger on a pivoting fitting to the sleeve.

14. The method of claim 12, further comprising attaching at least one clip to the sleeve.

15. The method of claim 6, wherein a terminus of the first side of each hook is attached to a bar of the hanger system.

16. The method of claim 6, wherein a terminus of the first side of each hook is attached to a surface.

17. The method of claim 16, wherein the surface comprises one of a wall, door and shelf.

* * * * *